US009229353B2

(12) United States Patent
Iwamoto

(10) Patent No.: US 9,229,353 B2
(45) Date of Patent: Jan. 5, 2016

(54) IMAGE FORMING APPARATUS

(71) Applicant: CANON KABUSHIKI KAISHA, Tokyo (JP)

(72) Inventor: Kazuyuki Iwamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/301,604

(22) Filed: Jun. 11, 2014

(65) Prior Publication Data

US 2014/0376974 A1 Dec. 25, 2014

(30) Foreign Application Priority Data

Jun. 20, 2013 (JP) ..... 2013-129411

(51) Int. Cl.

| | |
|---|---|
| ***G03G 15/04*** | (2006.01) |
| ***G03G 15/043*** | (2006.01) |
| ***G03G 15/01*** | (2006.01) |
| ***G03G 15/00*** | (2006.01) |

(52) U.S. Cl.

CPC ..... *G03G 15/043* (2013.01); *G03G 15/0189* (2013.01); *G03G 15/5058* (2013.01)

(58) Field of Classification Search

CPC ..... G03G 15/5054; G03G 15/5058; G03G 15/043; G03G 15/0415; G03G 15/04

See application file for complete search history.

(56) References Cited

U.S. PATENT DOCUMENTS

| | | | | |
|---|---|---|---|---|
| 4,669,864 | A * | 6/1987 | Shoji et al. | 399/349 |
| 8,417,162 | B2 * | 4/2013 | Matsuo | 399/301 |
| 2005/0002680 | A1 * | 1/2005 | Hattori | 399/49 |
| 2012/0045256 | A1 * | 2/2012 | Sasaoka et al. | 399/301 |
| 2013/0169731 | A1 * | 7/2013 | Mizuta et al. | 347/224 |
| 2013/0287442 | A1 * | 10/2013 | Birumachi | 399/167 |
| 2014/0314433 | A1 * | 10/2014 | Yamashita et al. | 399/49 |
| 2014/0376974 | A1 * | 12/2014 | Iwamoto | 399/301 |
| 2015/0016832 | A1 * | 1/2015 | Kumada et al. | 399/51 |

FOREIGN PATENT DOCUMENTS

JP 2006-323235 A 11/2006

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

In test modes correcting at least one of an exposure timing of a first exposure portion and an exposure timing of a second exposure portion after transferring test toner images on an endless belt, a control portion is configured to be able to start the exposure of the first exposure portion after a position of an intermediate transfer belt, having been located at a developing position when a developing bias is started to be applied to the second developing portion, arrives at a transfer position.

7 Claims, 11 Drawing Sheets

[NORMAL COLOR SHFIT CORRECTING MODE]

[NORMAL COLOR SHFIT CORRECTING MODE]

FIG.7A
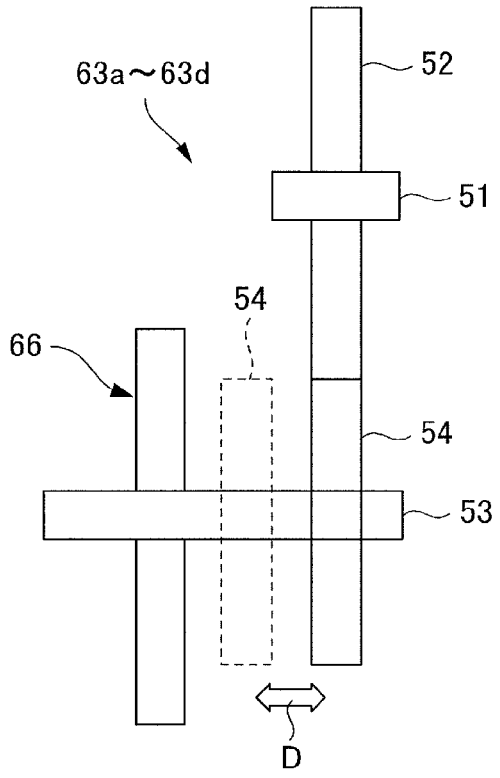
FIG.7B
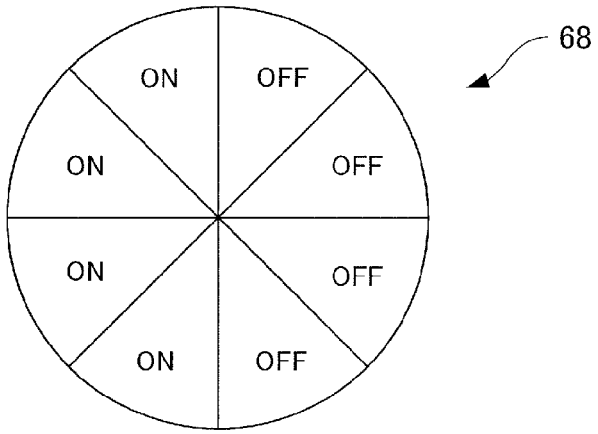
FIG.7C
CLUTCH TRANSMISSION STATE
| | Y | M | C | K |
|---|---|---|---|---|
| 1 | OFF | OFF | OFF | OFF |
| 2 | ON | OFF | OFF | OFF |
| 3 | ON | ON | OFF | OFF |
| 4 | ON | ON | ON | OFF |
| 5 | ON | ON | ON | ON |
| 6 | OFF | ON | ON | ON |
| 7 | OFF | OFF | ON | ON |
| 8 | OFF | OFF | OFF | ON |

IMAGE FORMING APPARATUS

BACKGROUND OF THE INVENTION

1. Field of the Invention

The present invention relates to an image forming apparatus such as a printer, a copier and others.

2. Description of the Related Art

Heretofore, there are various image forming apparatuses adopting an electro-photographic or electrostatic recording image forming process, and as one of such various image forming apparatuses, there is a tandem-type image forming apparatus including process cartridges arrayed in a row removably within a body of the image forming apparatus and configured to form a color image.

In such a tandem-type image forming apparatus, e.g., a contact developing type image forming apparatus, there is a possibility of causing the following problems if a developing state in which a developing bias is applied to a developing unit is continued until a non-image forming time during which no exposure is executed by an exposure unit:

(1) Scraping of a surface layer of a photosensitive body (photoconductive drum or the like) caused by being rubbed by a developing roller;

(2) Shortening of a life of photosensitive bodies of other colors not involved in development during monochrome printing in a black (Bk) monochrome mode;

(3) Waste of developer and adhesion of the developer to a recording medium during a non-developing operation during which no developing bias is applied; and (4) Deformation of a developing roller caused by being not used for a long period of time.

Meanwhile, there is a possibility that the following problems occur in the same manner also in a non-contact developing type image forming apparatus if the developing state in which a developing bias is applied to the developing unit is continued until when the non-image forming time during which no exposure is executed by the exposure unit;

(5) Deterioration of developer and toner; and (6) Increase of consumption of toner.

In order to solve the above mentioned problems, Japanese Patent Application Laid-open No. 2006-323235 proposes an image forming apparatus configured to operate such that the developing unit is put into the developing state only when an image of own color is to be formed for example. This apparatus is configured such that the developing units corresponding to yellow (Y), magenta (M), cyan (C) and black (Bk) are put into the developing states in this order in response to a start of an image forming operation of own color. Then, as soon as the image forming operation of own color ends, the developing units corresponding to the yellow (Y), magenta (M), cyan (C), and black (Bk) toner images are put into the non-developing states in this order.

However, according to the configuration described in Japanese Patent Application Laid-open No. 2006-323235, the following problem may occur if a coefficient of friction μl of a driving roller driving while supporting an intermediate transfer belt drops due to adhesion of flying toner and paper powder while repeating the image forming operations (durability). That is, there is a case where a slip occurs between the intermediate transfer belt and the driving roller, causing a minute fluctuation of speed of the intermediate transfer belt, during when the developing units are switched to the developing states.

One reason of this problem is that a coefficient of friction μ2 between the photoconductive drum and the intermediate transfer belt when toner exists in the primary transfer nip portion between the primary transfer roller and the intermediate transfer belt is different from a coefficient of friction μ3 between the photoconductive drum and the intermediate transfer belt when no toner exists in the photoconductive drum.

That is, assuming nip pressure between the driving roller and the secondary transfer roller facing with each other and pinching the intermediate transfer belt as F1, nip pressure of the primary transfer nip portion as F2, and that there exist four photoconductive drums, their relationship in an initial state is differentiated after forming a certain number of images. That is, the relationship in the initial state of:

$$\mu 2 \times F2 \times 4 < \mu 3 \times F2 \times 4 < \mu 1 \times F1$$

is changed to a relationship of:

$$\mu 2 \times F2 \times 4 < \mu 1 \times F1 < \mu 3 \times F2 \times 4$$

after forming the certain number of images.

This tendency is more remarkable in a small type image forming apparatus in which a diameter of a driving roller of an intermediate transfer belt is small.

In the case where the minute fluctuation of speed of the intermediate transfer belt occurs as described above, there is a problem that color shift correction becomes insufficient due to a minute detection error also in a color shift correction control conducted by forming a color shift correcting pattern image on the intermediate transfer belt as follows. That is, the problem occurs in a so-called automatic registration adjustment of adjusting timings for exposing the photoconductive drums from a scan type optical unit per each color by detecting the correcting pattern image on the intermediate transfer belt by a color shift amount detecting portion such as a CCD sensor and by detecting a color shift amount of each color.

After forming the certain number of images, if the developing units are put into the developing state only in forming own image as described in the configuration of Japanese Patent Application Laid-open No. 2006-323235, the other developing units of magenta, cyan and black are put into the non-developing state in forming an initial yellow image, and the state of coefficient of friction μ3 in which there exists no toner in the primary transfer nip portions of magenta, cyan and black is brought about. Due to that, a slip tends to occur between the intermediate transfer belt and the driving roller even though it is a level in which unevenness is unnoticeable as an image shock. If the slip occurs between the intermediate transfer belt and the driving roller during the so-called auto-registration, intervals of each color of the color shift correcting pattern formed on the intermediate transfer belt become unstable, i.e., the color shift correction becomes insufficient, possibly causing a color shift during printing on a sheet.

SUMMARY OF THE INVENTION

According to one aspect of the invention, an image forming apparatus includes an endless belt rotatingly conveying toner images transferred thereon, a first image carrier rotatably supported in a state in contact with the endless belt, a second image carrier rotatably supported in a state in contact with the endless belt and in parallel with the first image carrier downstream the first image carrier in a rotational direction of the endless belt, a first exposure portion exposing the charged first image carrier and forming a latent image thereon, a second exposure portion exposing the charged second image carrier and forming a latent image thereon, a first developing portion developing the latent image formed on the first image carrier as one of the toner images at a first developing position by applying a developing bias, a second developing portion developing the latent image formed on the second image carrier as one of toner images at a second developing position by applying a developing bias, a transfer portion transferring the toner image transferred from the first image carrier to the endless belt at a first transfer position and the toner image transferred from the second image carrier to the endless belt at a second transfer position collectively to a recording medium conveyed thereto, and a control portion selectively executing, corresponding to a predetermined condition, a first or second test mode correcting at least one of exposure timings of the first exposure portion and the second exposure portion after transferring test toner images respectively from the first and second image carriers to the endless belt, the control portion starting the exposure of the first exposure portion after when a position of the second image carrier located at a second developing position when the developing bias is started to be applied to the second developing portion arrives at the second transfer position in forming the test toner images in the first test mode, and the control portion starting the exposure of the first exposure portion before when the position of the second image carrier located at the second developing position when the developing bias is started to be applied to the second developing portion arrives at the second transfer position in forming the test toner image in the second test mode.

According to another aspect of the invention, an image forming apparatus includes an endless belt rotatingly conveying toner images transferred thereon, a first image carrier rotatably supported in a state in contact with the endless belt, a second image carrier rotatably supported in a state in contact with the endless belt and in parallel with the first image carrier downstream the first image carrier in a rotational direction of the endless belt, a first exposure portion exposing the charged first image carrier and forming a latent image thereon, a second exposure portion exposing the charged second image carrier and forming a latent image thereon, a first developing portion developing the latent image formed on the first image carrier as a toner image at a first developing position by applying a developing bias, a second developing portion developing the latent image formed on the second image carrier as a toner image at a second developing position by applying a developing bias, a transfer portion transferring the toner image transferred from the first image carrier to the endless belt at a first transfer position and the toner image transferred from the second image carrier to the endless belt at a second transfer position collectively to a recording medium conveyed thereto, and a control portion starting the exposure of the first exposure portion after when a position of the second image carrier located at the second developing position when a developing bias is started to be applied to the second developing portion arrives at the second transfer position in test modes correcting at least one of the exposure timings of the first exposure portion and of the second exposure portion after transferring test toner images respectively from the first and second image carriers to the endless belt.

Further features of the present invention will become apparent from the following description of exemplary embodiments with reference to the attached drawings.

BRIEF DESCRIPTION OF THE DRAWINGS

FIG. 7A is a schematic diagram showing a clutch and a transmission gear thereof of the developing unit.

FIG. 7B is a diagram explaining timings of ON and OFF of the clutch of the developing unit.

FIG. 7C is a table showing the transmission state of the clutch of the developing unit.

DESCRIPTION OF THE EMBODIMENTS

First Embodiment

Figure 1:
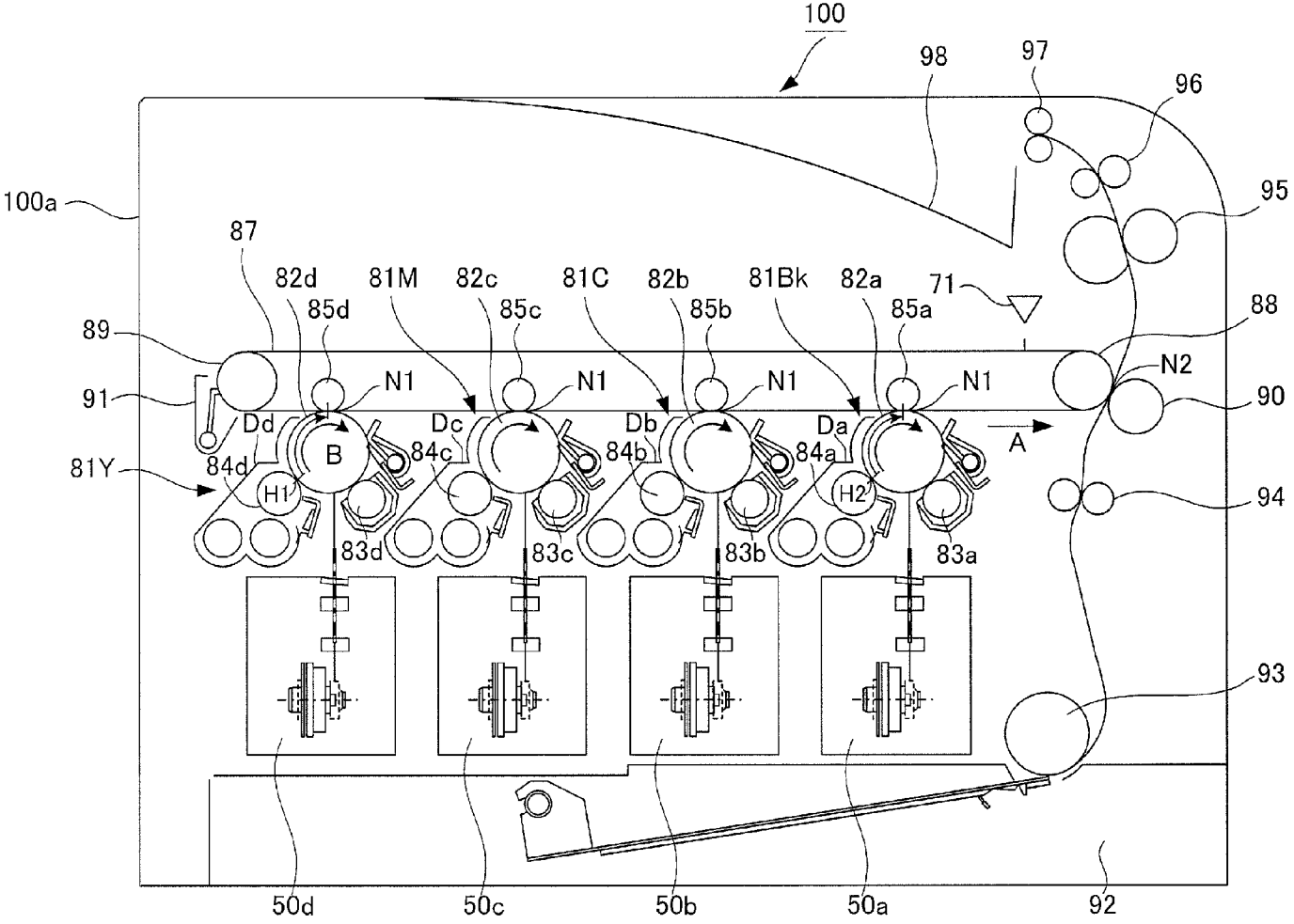
FIG. 1 is a schematic section view showing a tandem-type color printer as an image forming apparatus of a first embodiment of the present invention.

Embodiments of the present invention will be described below with reference to the drawings. FIG. 1 is a schematic section view showing an image forming apparatus such as a tandem-type color printer according to a first embodiment and FIG. 2 is a schematic section view showing image forming portions of the first embodiment of the invention.

As shown in FIG. 1, the image forming apparatus 100 has a body 100*a* of the apparatus 100 (referred to simply as an 'apparatus body' hereinafter). The image forming apparatus 100 includes image forming portions 81Y, 81M, 81C and 81Bk, i.e., four image forming units arrayed in a row at certain intervals from an upstream side to a downstream side along a rotational direction (in a direction of an arrow A in FIG. 1) of an intermediate transfer belt 87 within the image forming apparatus 100*a*. The intermediate transfer belt 87 composes an endless belt rotating and conveying toner images transferred thereon.

The image forming portion 81Y forms a yellow (Y) color image, the image forming portion 81M forms a magenta (M) color image, the image forming portion 81C forms a cyan (C) color image, and the image forming portion 81Bk forms a black (Bk) color image. A registration detection sensor 71 is disposed above the intermediate transfer belt 87 on a driving roller 88 side.

Figure 2:
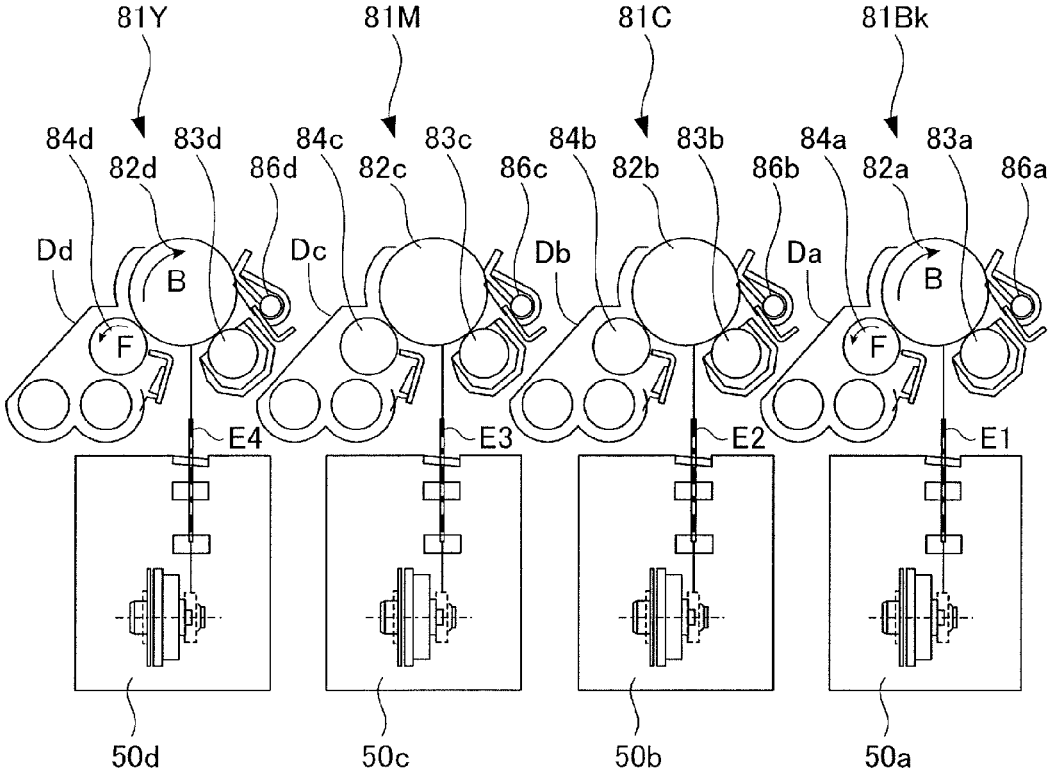
FIG. 2 is a schematic section view showing image forming portions of the first embodiment of the invention.

As shown in FIG. 2, the image forming portions 81Bk, 81C, 81M and 81Y are provided with drum-type photosensitive bodies (referred to as photoconductive drums hereinafter) 82*a*, 82*b*, 82*c* and 82*d*, respectively. Provided around the photoconductive drums 82*a* through 82*d* are charging units 83*a*, 83*b*, 83*c* and 83*d*, developing units Da, Db, Dc and Dd, primary transfer rollers 85*a*, 85*b*, 85*c* and 85*d*, and drum cleaner units 86*a*, 86*b*, 86*c* and 86*d*, respectively.

Provided below a part between the charging unit 83*a* and the developing unit Da of the image forming portion 81Bk is a scan-type optical unit (referred to as an 'exposure unit' hereinafter) 50*a*, and provided below a part between the charging unit 83*b* and the developing unit Db of the image forming portion 81C is an exposure unit 50*b*. Still further, provided below a part between the charging unit 83*c* and the developing unit Dc of the image forming portion 81M is an exposure unit 50*c*, and provided below a part between the charging unit 83*d* and the developing unit Dd of the image forming portion 81Y is an exposure unit 50*d*.

Charging units 83*a*, 83*b*, 83*c* and 83*d* charge the respective surfaces of the corresponding photoconductive drums 82*a*, 82*b*, 82*c* and 82*d* homogeneously at predetermined negative potential by a charging bias applied from a charging bias power source not shown.

The developing units Da, Db, Dc and Dd store toners of black, cyan, magenta and yellow colors, respectively. The developing units Da, Db, Dc and Dd include developing rollers 84*a*, 84*b*, 84*c* and 84*d*, respectively. Each of the developing rollers 84*a* through 84*d* starts to develop by rotating in a direction (direction of an arrow F in FIG. 2) opposite from the rotational direction of the corresponding photoconductive drums 82*a* through 82*d* from a point of time when a developing bias is applied in a state in which the developing rollers 84*a* through 84*d* are in contact with corresponding ones of the photoconductive drums 82*a*, 82*b*, 82*c* and 82*d*. It is noted while the contact type developing rollers 84*a* through 84 will be explained in the present embodiment, the present invention is not limited to that case and it is possible to adopt a configuration using non-contact type developing rollers.

Each of the photoconductive drums 82*a*, 82*b*, 82*c* and 82*d* includes a photoconductive layer on a drum base made of aluminum, i.e., a negatively charged OPC photosensitive body (organic photoconductor), and is rotated and driven at a predetermined processing speed in a direction of an arrow B in FIGS. 1 and 2.

The developing unit Da applies the black color toner to an electrostatic latent image formed on the corresponding photoconductive drum 82*a* and develops (visualizes) as a toner image. The developing unit Db applies the cyan color toner to an electrostatic latent image formed on the corresponding photoconductive drum 82*b* and develops (visualizes) as a toner image. The developing unit Dc applies the magenta color toner to an electrostatic latent image formed on the corresponding photoconductive drum 82*c* and develops (visualizes) as a toner image. The developing unit Dd applies the yellow color toner to an electrostatic latent image formed on the corresponding photoconductive drum 82*d* and develops (visualizes) as a toner image.

The primary transfer rollers 85*a*, 85*b*, 85*c* and 85*d* are in contact with the photoconductive drums 82*a* through 82*d*, respectively, through an intermediary of the intermediate transfer belt 87 at each primary transfer nip portion N1 (see FIG. 1).

Each of the drum cleaner units 86*a* through 86*d* includes a cleaning blade and others and removes residual toner on a corresponding one of the photoconductive drums 82*a* through 82*d* that has remained after the primary transfer.

In the first embodiment and in second and third embodiments described later, the photoconductive drum 82*d* composes a first image carrier supported rotatably in a state in contact with the intermediate transfer belt 87, and the photoconductive drum 82*a* composes a second image carrier supported rotatably in a state in contact with the intermediate transfer belt 87 and in parallel with photoconductive drum 82*d* at a downstream side in the rotational direction of the intermediate transfer belt 87 from the photoconductive drum 82*d*, i.e., the first image carrier.

Still further, the exposure unit 50*d* composes a first exposure portion exposing the charged photoconductive drum 82*d* and forming a latent image, and the exposure unit 50*a* composes a second exposure portion exposing the charged photoconductive drum 82*a* and forming a latent image. The developing unit Dd composes a first developing portion developing the latent image formed on the photoconductive drum 82*d* as a toner image at a first developing position H1 (see FIG. 1) by applying a developing bias, and the developing unit Da composes a second developing portion developing the latent image formed on the photoconductive drum 82*a* as a toner image at a second developing position H2 (see FIG. 1) by applying a developing bias.

The primary transfer roller 85*d* primarily transfers the toner image on the photoconductive drum 82*d* (the first image carrier) to the intermediate transfer belt 87 at the primary transfer nip portion N1, i.e., a first transfer position, between the primary transfer roller 85*d* and the photoconductive drum 82*d*.

The primary transfer roller 85*a* primarily transfers the toner image on the photoconductive drum 82*a* to the intermediate transfer belt 87 at the primary transfer nip portion N1, i.e., the first transfer position. The primary transfer roller 85*a* primarily transfers the toner image on the photoconductive drum 82*a* (on the second image carrier) to the intermediate transfer belt 87 in a manner of superimposing on the toner image primarily transferred by the primary transfer roller 85*d*.

As shown in FIG. 1, the intermediate transfer belt 87 is stretched between the driving roller 88 and a belt conveying roller 89 and is rotationally moved in the direction of an arrow A (counterclockwise in FIG. 1). The intermediate transfer belt 87 is composed of a dielectric resin such as polycarbonate, a polyethylene-terephthalate resin film, a polyvinylidene fluoride resin, or the like.

The driving roller 88 is disposed to face a secondary transfer roller 90 and forms a secondary transfer portion (secondary transfer nip portion N2, transfer portion) by being in contact with the secondary transfer roller 90 through an intermediary of the intermediate transfer belt 87. The secondary transfer portion N2 secondarily transfers the toner image primarily transferred to the intermediate transfer belt 87 to a recording medium conveyed thereto. That is, the secondary transfer portion N2 transfers the toner image transferred from the photoconductive drum 82*d* to the intermediate transfer belt 87 at the first transfer position, the toner image transferred from the photoconductive drum 82*a* to the intermediate transfer belt 87 and others collectively to the recording medium conveyed thereto. Provided also in a vicinity of the belt conveying roller 89 on an outer circumferential side of the intermediate transfer belt 87 is a belt cleaning unit 91 removing and recovering transfer residual toner left on the surface of intermediate transfer belt 87.

A sheet feed cassette 92 storing sheet-like recording media is disposed at an under part within the image forming apparatus 100*a*. The recording media within the sheet feed cassette 92 is fed one by one by a sheet feeding roller 93 disposed downstream in the sheet feed direction of the sheet feed cassette 92. The recording medium is stopped once as it is conveyed to a registration roller pair 94 disposed along a conveying path between the sheet feeding roller 93 and the secondary transfer roller 90, and its conveyance is started by matching timing such that the toner image is transferred to a predetermined position of the recording medium at the secondary transfer portion N2. The recording medium on which the toner image has been secondarily transferred at the secondary transfer portion N2 is heated by a fixing unit 95 disposed downstream the secondary transfer portion N2 to fix the toner image on the recording medium and is conveyed and discharged to a sheet discharge tray 98 through a conveying roller pair 96 and a sheet discharge roller pair 97.

Figure 3:
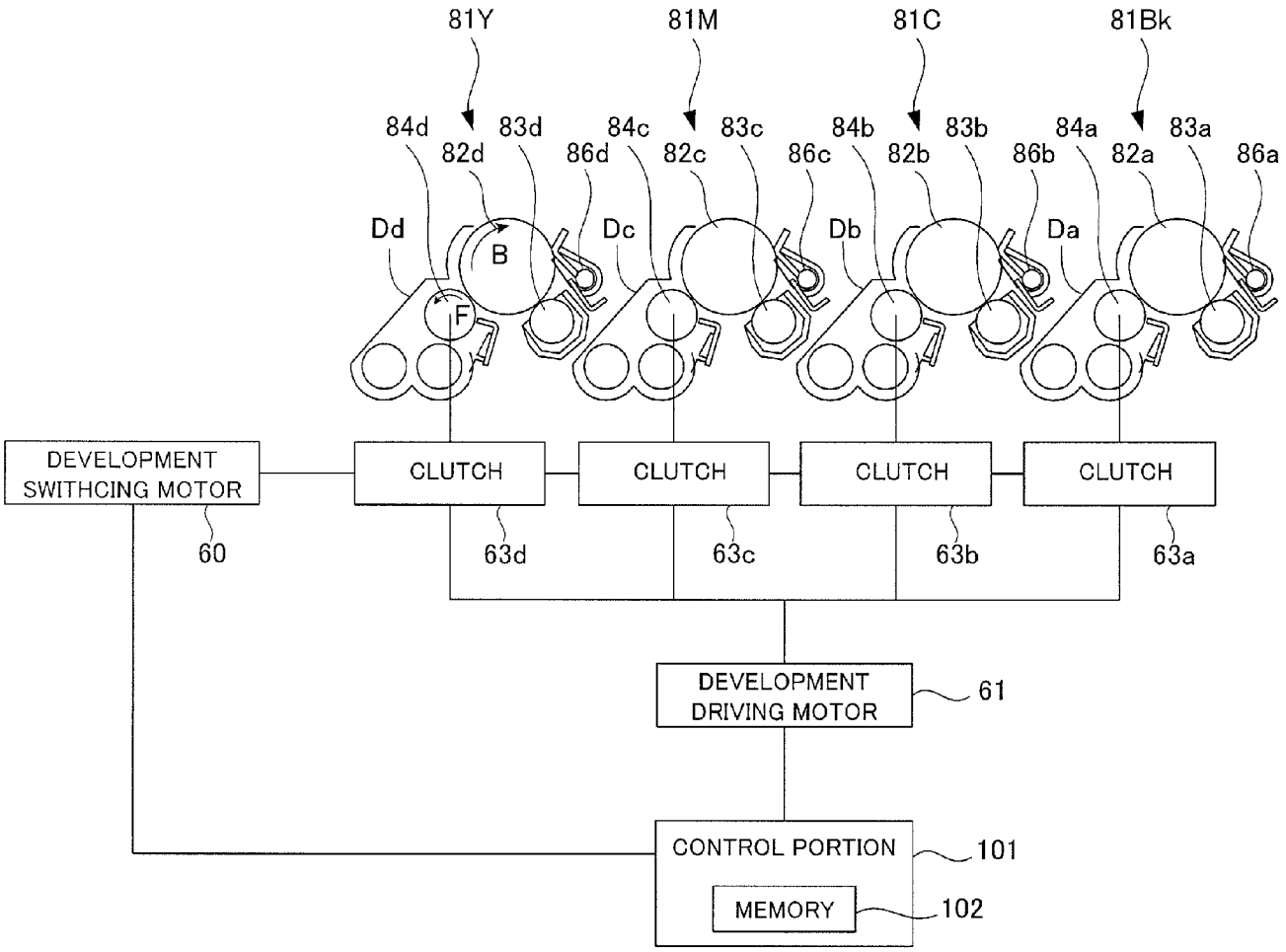
FIG. 3 is a block diagram showing a control system in driving developing units according to the first embodiment.

Next, a configuration of driving and controlling the developing units Da through Dd of the present embodiment will be explained with reference to FIG. 3. FIG. 3 is a block diagram showing the configuration (system) for driving and controlling the developing units Da through Dd of the present embodiment.

As shown in FIG. 3, the system for driving and controlling the developing units Da through Dd includes mechanical clutches 63*a* through 63*d* respectively driving the developing rollers 84*a* through 84*d* included in the developing units Da through Dd. This driving and controlling system further includes a development switching motor 60 switching a transmission state and a non-transmission state of the clutches 63*a* through 63*d*, a development driving motor 61 driving the developing rollers 84*a* through 84*d* through the clutches 63*a* through 63*d*, and a control portion 101. The control portion 101 includes a memory 102 composed of a RAM, a ROM and others not shown.

The control portion 101 selectively executes first and second test modes of correcting at least one of each exposure timing of the exposure unit 50*d* and the exposure unit 50*a* after transferring test toner images respectively from the photoconductive drums 82*d* and 82*a* to the intermediate transfer belt 87 selectively corresponding to a predetermined condition. That is, the control portion 101 selectively executes, corresponding to the predetermined condition, a low μ color shift correcting mode (first test mode: see FIGS. 6 and 10) or a normal color shift correcting mode (second test mode: see FIG. 4) executing a color shift correcting operation by forming the test toner images on the intermediate transfer belt 87.

Specifically, as described later, the control portion 101 executes the first test mode as follows. That is, the control portion 101 starts exposure of the exposure unit 50*d* after when a position of the photoconductive drum 82*a* (the second image carrier) which has been located at a second developing position (H2) when a developing bias is started to be applied to the developing unit Da (the second developing portion) arrives at a second transfer position (N1). Still further, in the second test mode, the control portion 101 starts the exposure of the exposure unit 50*d* (the first exposure portion) before when the position of the photoconductive drum 82*a* which has been located at the second developing position (H2) when the developing bias is started to be applied to the developing unit Da arrives at the second transfer position (N1).

That is, in the low μ color shift correcting mode as the first test mode, the control portion 101 starts to form a latent image on the photoconductive drum 82*d* by the exposure unit 50*d* after when the position of the photoconductive drum 82*a* located at the second developing position H2 (see FIG. 1) when the developing bias is started to be applied to the developing unit Da arrives at the primary transfer nip portion N1 (the second transfer position).

Further, in the normal color shift correcting mode as the second test mode, the control portion 101 starts to form a latent image on the photoconductive drum 82*d* before when the position of the photoconductive drum 82*a* located at the second developing position H2 when the developing bias is started to be applied to the developing unit Da arrives at the primary transfer nip portion N1 (the second transfer position).

The control portion 101 controls the image forming operations including not only the drive of the developing units Da through Dd by driving the development switching motor 60 and the development driving motor 61 but also the drives of the photoconductive drums 82*a* through 82*d*, the charging units 83*a* through 83*d*, the primary transfer rollers 85*a* through 85*d*, and the intermediate transfer belt 87. The control portion 101 also controls operations such as conveyance of the recording medium including drives of the sheet feeding roller 93, the registration roller pair 94, the secondary transfer roller 90, the fixing unit 95, the conveying roller pair 96 and the sheet discharge roller pair 97, and formation of a registration correcting pattern described later.

The memory 102 within the control portion 101 stores a total number of times of printing and a color shift amount to yellow, i.e., a reference color, detected by a registration detecting sensor 71 such that the control portion 101 can perform registration correction by controlling the exposure corresponding to each color in forming an image.

The developing rollers 84*a* through 84*d* of the developing units Da through Dd are driven respectively by the development driving motor 61, e.g., a DC motor, and the drive is transmitted only at the timing of 'development ON'. The developing units Da through Dd are constructed such that phases of a cam 68 is changed so that the transmission and non-transmission states of the clutches 63*a* through 63*d* are switched one by one based on that the development switching motor 60 composed by a stepping motor is driven by each predetermined step under the control of the control portion 101.

A specific configuration for switching the respective clutches 63*a* through 63*d* of the developing units Da through Dd will be explained with reference to FIGS. 7A through 7C.

That is, as shown in FIG. 7A, each of the clutches 63*a* through 63*d* of the developing units Da through Dd includes a rotational shaft 53 rotatably supported to each casing not shown of the developing units Da through Dd and a rotational shaft 51 rotatably supported in parallel with the rotational shaft 53.

Supported fixedly to the rotational shaft 53 are a clutch switching gear 66 transmitting rotations from the development switching motor 60 (see FIG. 3) and a drive switching gear 54 so as to be slidable in an axial direction. The drive switching gear 54 is allowed to slidably move in the axial direction in a state in which a circumferential rotation thereof with respect to the rotational shaft 53 is restricted. A driving gear 52 transmitting rotations from the development driving motor 61 (see FIG. 3) is fixedly supported by the rotational shaft 51.

There is provided cams 68 in each of the clutches of the developing units Da through Dd. Each of the cams 68 is configured such that the drive switching gear 54 is switched to the transmission and non-transmission states in accordance to changes of phases of the cam 68 by rotation of each clutch switching gear 66 of the developing units Da through Dd. That is, each cam 68 corresponding to the developing units Da through Dd has eight ON and OFF switching areas divided per 45° in the circumferential direction as shown in FIG. 7B.

Thereby, as shown in FIG. 7C, the drive switching gear 54 is switched to a position of a broken line in FIG. 7A to turn OFF (to the non-transmission state) by the area 1 in the developing unit Dd corresponding to yellow (Y) by the cam 68 rotating in one direction. Still further, the drive switching gear 54 is switched to a position of a solid line in FIG. 7A by the areas 2 through 5 to turn ON (to the transmission state), and the drive switching gear 54 is switched to the position of the broken line to turn OFF (to the non-transmission state) by the areas 6 through 8.

In the developing unit Dc corresponding to magenta (M), the drive switching gear 54 is switched to the broken line position to turn OFF by the areas 1 and 2, and the drive switching gear 54 is switched to the solid line position to turn ON by the areas 3 through 6. Still further, the drive switching gear 54 is switched to the broken line position by the areas 7 and 8 to turn OFF.

In the developing unit Db corresponding to cyan (C), the drive switching gear 54 is switched to the broken line position to turn OFF by the areas 1 through 3, the drive switching gear 54 is switched to the solid line position to turn ON by the areas 4 through 7, and the drive switching gear 54 is switched to the broken line position by the area 8 to turn OFF.

In the developing unit Da corresponding to black (K(Bk)), the drive switching gear 54 is switched to the broken line position to turn OFF by the areas 1 through 4, and the drive switching gear 54 is switched to the solid line position to turn ON by the areas 5 through 8.

By the configuration described above, each of the clutches 63*a* through 63*d* of the developing units Da through Dd sequentially switches the developing rollers 84*a* through 84*d* to the development enabling state and the development disabling state as shown in FIG. 7C by receiving the rotations of one direction of the development switching motor 60 under the control of the control portion 101.

An explanation will be made below on cases where color shift correction is made by detecting registration correcting patterns of each color by using the charging units 83*a* through 83*d*, the primary transfer rollers 85*a* through 85*d*, the developing units Da through Dd, and the exposure units 50*a* through 50*d* configured as described above.

That is, the registration detecting sensor 71 (see FIG. 1) detects the registration correcting pattern (registration correcting toner patch) of each color formed on an outer circumferential surface out of a normal image forming area of the intermediate transfer belt 87. Based on this detection, the control portion 101 detects a color shift amount from a positional shift amount of the registration correcting pattern of the other color to a registration correcting pattern of yellow, i.e., a reference color. The reason why yellow is set as the reference color in the present embodiment is because the image forming portion 81Y is separated most from the fixing unit 95 and sizes are changed less due to thermal expansion of parts caused by heat of the fixing unit 95.

Here, an influence of the image forming number to the drop of the coefficient of friction μ1 of the driving roller 88 found by experiments in the image forming apparatus 100 such as a tandem-type color printer of the present embodiment will be explained with reference to FIG. 5.

Figure 5:
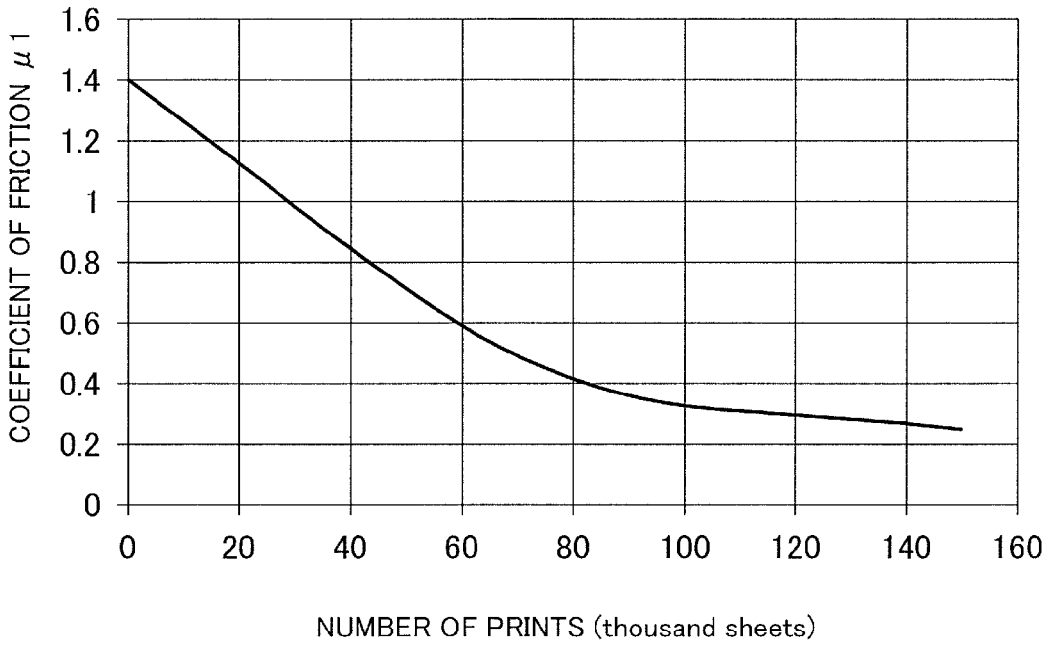
FIG. 5 is a graph showing changes caused by durability of a coefficient of friction μ1 of a driving roller in the first embodiment.

That is, as it can be seen from FIG. 5, if the coefficient of friction μ1 drops under 0.35, a slip occurs between the driving roller 88 and the intermediate transfer belt 87, and the intermediate transfer belt 87 causes a minute fluctuation of speed in this experiment. It is noted that a horizontal axis represents a number of prints (thousand sheets) and a vertical axis represents the coefficient of friction μl in the graph in FIG. 5.

Figure 4:
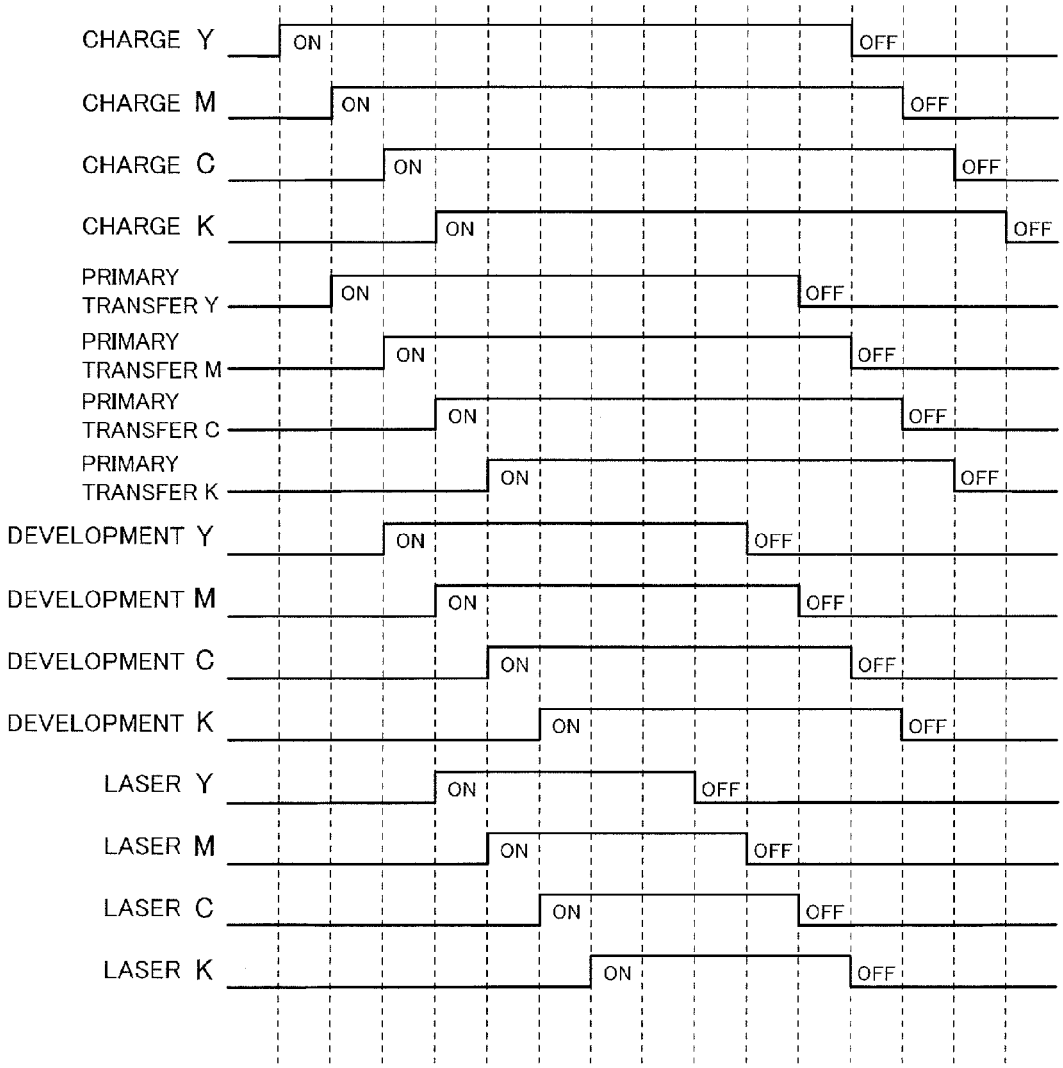
FIG. 4 is a time chart showing driving states of the image forming portions during a normal color shift correction mode of the first embodiment.

Due to that, the normal color shift correcting mode is adopted until when a total number of times of print stored in the memory 102 reaches 80 (thousand sheets), and the driving timings shown in the time chart in FIG. 4 are adopted as the driving timings of the image forming portions 81K through 81Y in detecting a registration correcting amount and in printing on the recording media. When the total number of times of print exceeds 80 (thousand sheets) after that, the driving timings of the image forming portions 81K through 81Y in detecting the registration correcting amount and in printing on the recording media are put into the low μ color shift correcting mode and are changed as shown in the time chart in FIG. 6.

That is, the control portion 101 executes the normal color shift correcting mode until when an accumulated number of transfer from the intermediate transfer belt 87 to the recording media by the secondary transfer roller 90 (secondary transfer nip portion N2) exceeds a predetermined number and executes the low μ color shift correcting mode after when the accumulated number of times of transfer exceeds the predetermined number. It is noted that the predetermined number may be 80 (thousand sheets) for example.

Such mode switching control can be made both in the color shift correction and in an image forming operation of forming a normal toner image on a recording medium.

Here, a registration correcting operation in the normal color shift correcting mode will be explained with reference to FIG. 4. It is noted that while the operation in determining the registration correcting amount is carried out while turning on the image forming apparatus 100, after printing on a predetermined number of recording media, or after an elapse of a predetermined time, the operation time will not be specifically limited here.

At first, in forming the test toner images described above to carry out the registration correction, the control portion 101 controls the respective image forming portions 81Y, 81M, 81C, and 81Bk to form the test toner images in order of application of a charging bias to the charging unit (referred to simply as 'turn ON the charging unit' hereinafter), application of the primary transfer bias to the primary transfer roller (referred to simply as 'turn ON the primary transfer roller' hereinafter), switching the clutch of the developing unit to the transmission state (referred to simply as "turn ON the developing unit" hereinafter), and exposure to the photoconductive drum by the exposure unit (referred to simply as 'turn ON the exposure unit' hereinafter). The control portion 101 also controls the respective image forming portions 81Y, 81M, 81C, and 81Bk such that the series of operations described above is started in order from the image forming portion distant from the secondary transfer portion N2 to the image forming portion close to the secondary transfer portion N2 (in order from the image forming portion 81Y toward the image forming portion 81Bk in the present embodiment).

Here, while the control portion 101 applies the primary transfer bias to the primary transfer roller 85*d* of yellow right after when the Yellow charging unit 83*d* is turned ON, the control portion 101 overlaps the application timing of the primary transfer bias to the primary transfer roller 85*d* of yellow with ON timing of the charging unit 83*c* of magenta. The control portion 101 also controls such that ON timing of the charging unit 83*d* of cyan overlaps with ON timing of the developing unit Dd of yellow. The control portion 101 also controls such that ON timing of the charging unit 83*a* of black overlaps with ON timing of the exposure unit 50*a* of yellow. Thus, in the normal color shift correcting mode, the series of the test toner image forming operations carried out by the image forming portions 81Y, 81M, 81C, and 81Bk is overlapped with each other to shorten a total time required to form the test toner images. In particular, because ON timing of the exposure unit of the image forming portion 81Y of yellow whose starting timing is fastest in the series of test toner image forming operations described above is started without waiting ON timing of the developing unit of the image forming portion 81K of black whose starting timing is latest in the series of test toner image forming operations described above in the normal color shift correcting mode, the total time required to form the test toner images can be shortened more by that time.

More specifically, the control portion 101 drives the development switching motor 60 by a predetermined step to put the drive of the clutch 63*d* into the transmission state and turns ON the developing unit Dd of yellow. After that, the control portion 101 drives the development switching motor 60 by predetermined step each to put the drive of the clutches 63*c*, 63*b*, and 63*a* sequentially into the transmission state (see FIG. 7C), and turns ON the developing units Dc, Db and Da of magenta, cyan and black. Then, the control portion 101 overlaps ON timing of the developing unit Dd of yellow with ON timing of the primary transfer roller 85*c* of magenta.

The control portion 101 also sequentially irradiates and scans a laser beam, i.e., a scanning beam, from the exposure unit 50*d* of yellow to the photoconductive drum 82*d* of yellow, from the exposure unit 50*c* of magenta to the photoconductive drum 82*c* of magenta, from the exposure unit 50*b* of cyan to the photoconductive drum 82*b* of cyan, and from the exposure unit 50*a* of black to the photoconductive drum 82*a* of black, respectively. An electrostatic latent image is formed on the photoconductive drum 82*d* charged by the charging unit 83*d* as the photoconductive drum 82*d* is exposed in the yellow image forming process. Here, the exposure of the yellow photoconductive drum 82*d* is started from the exposure unit 50*d* of yellow before the developing unit Da of black is turned ON. Therefore, while no fogging toner arrives at the primary transfer nip portion N1 of black, no slip occurs between the driving roller 88 and the intermediate transfer belt 87 because it is a time before the μ1 of the coefficient of friction of the driving roller 88 drops.

Yellow toner frictionally electrified within the developing unit Dd is applied to the electrostatic latent image of the photoconductive drum 82*d* to form a toner image. The formed toner image is then primarily transferred from the photoconductive drum 82*d* to the intermediate transfer belt 87 at the primary transfer nip portion N1 of the primary transfer roller 85*d*. Images of magenta, cyan and black are also formed on the intermediate transfer belt 87 in the same manner at the primary transfer nip portion N1 at predetermined timings. The registration detecting sensor 71 detects the registration correcting patterns of each color formed on the intermediate transfer belt 87 and the control portion 101 detects a color shift amount with respect to yellow, i.e., a reference color, and stores it in the memory 102.

Next, the registration correcting operation in the low μ color shift correcting mode in the case where the total number of times of print exceeds 80 (thousand sheets) will be explained with reference to FIG. 6.

While the control portion 101 controls the image forming portions 81Y, 81M, 81C, and 81Bk, respectively, such that the series of the image forming operations of the test modes is started in order from the image forming portion distant from the secondary transfer portion N2 toward the image forming portion close to the secondary transfer portion N2 also in the low μ color shift correcting mode, the exposure unit 50*d* of yellow is turned ON after when the developing units Dd through Da of the respective image forming portions 81Y, 81M, 81C, and 81Bk are turned ON. Specifically, the control portion 101 turns ON the charging unit 83*d* of yellow, the charging unit 83*c* of magenta, the charging unit 83*b* of cyan, and the charging unit 83*a* of black, sequentially. The control portion 101 also applies the primary transfer bias to the primary transfer roller 85*d* of yellow, the primary transfer roller 85*c* of magenta, the primary transfer roller 85*b* of cyan, and 85*a* of black, sequentially.

Here, while the primary transfer bias is applied to the primary transfer roller 85*d* of yellow after the charging unit 83*d* of yellow, a time is shortened by overlapping with ON timing of the charging unit 83*c* of magenta. Next, the control portion 101 puts the drive of the clutch 63*d* into the transmission state and turns ON the developing unit Dd of yellow by driving the development switching motor 60 by predetermined steps.

After that, the control portion 101 drives the development switching motor 60 by each predetermined step to put the drive of the clutches 63*c*, 63*b* and 63*a* sequentially into the transmission state and turns ON the developing unit Dc, Db and Da of magenta, cyan and black. The developing unit Dd of yellow is turned ON after when the primary transfer bias is applied to the primary transfer roller 85*d* of yellow also in this case, it is overlapped with ON timing of the primary transfer roller 85*c* of magenta.

Thus, the developing unit Da of black is turned ON (time $T_1$ in FIG. 6), and the registration correcting pattern of each color formed on the intermediate transfer belt 87 is sequentially exposed by the laser beam as a scanning light based on image information after waiting for the fogging toner to arrive at the primary transfer nip portion N1. That is, the laser beam is irradiated as the scanning beam sequentially from the exposure unit 50*d* of yellow to the photoconductive drum 82*d* of yellow, from the exposure unit 50*c* of magenta to the photoconductive drum 82*c* of magenta, from the exposure unit 50*b* of cyan to the photoconductive drum 82*b* of cyan, and from the exposure unit 50*a* of black to the photoconductive drum 82*a* of black. In the yellow image forming process, an electrostatic latent image is formed on the photoconductive drum 82*d* charged by the charging unit 83*d* as the photoconductive drum 82*d* is exposed (at time $T_2$ in FIG. 6).

Figure 6:
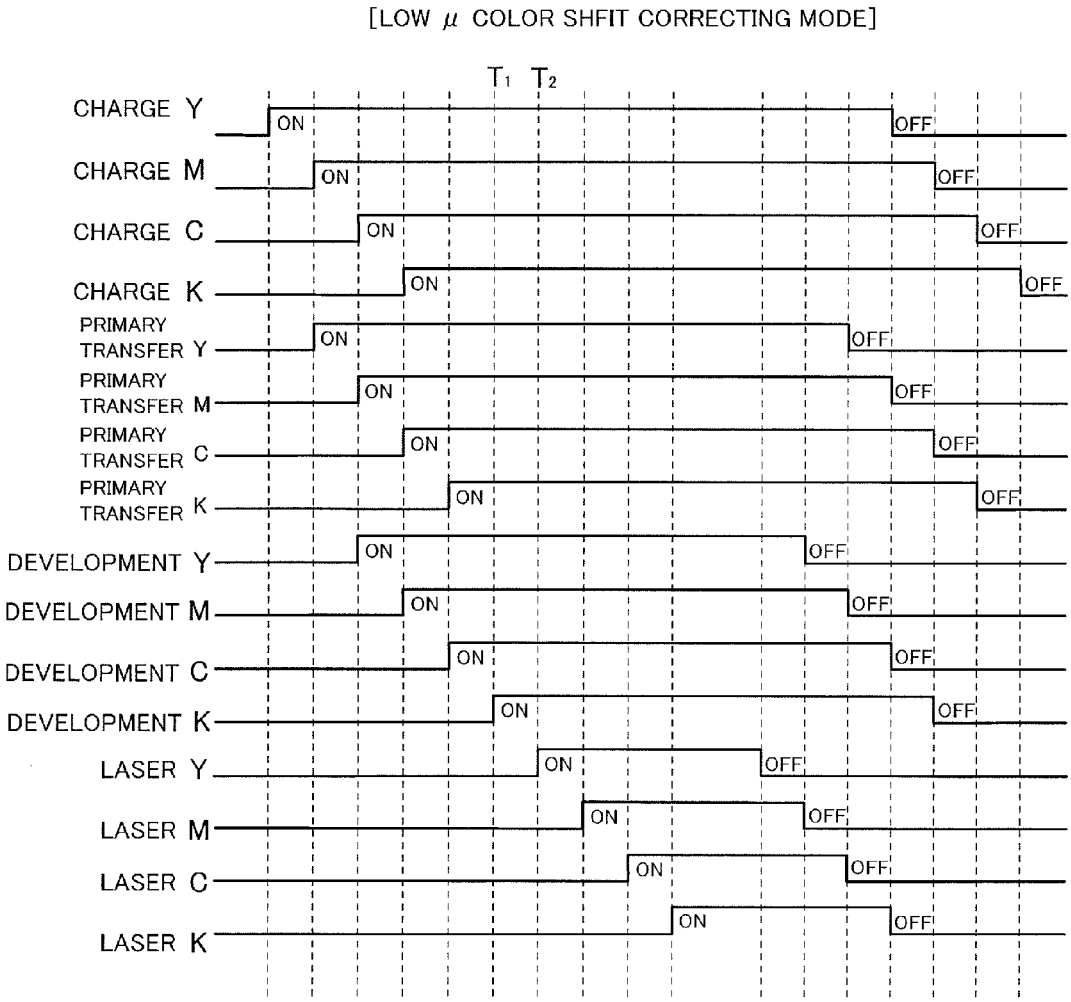
FIG. 6 is a time chart showing driving states of the image forming portions during a low μ color shift correction mode of the first embodiment.

It is noted that although FIG. 6 describes the timing (time $T_1$) when the developing unit Da is turned ON and the timing (time $T_2$) when the exposure unit 50*d* is turned ON with the continuous same timing, the timing is not limited to that timing. That is, it is also possible to control such that the exposure unit 50*d* is turned ON slightly later than the time $T_2$ shown in FIG. 6 after when the developing unit Da is turned ON. This arrangement also enables to obtain the same effect.

It is noted that the fogging toner described above means toner not intended to use in the image forming process and naturally adhering from the developing rollers 84*a* through 84*d* to the corresponding photoconductive drums 82*a* through 82*d* when the developing bias is applied and the developing units Da through Dd are turned ON under the control of the control portion 101.

After that, the yellow toner frictionally electrified within the developing unit Dd is applied to the electrostatic latent image on the photoconductive drum 82*d* to form a toner image. The toner image thus formed is primarily transferred from the photoconductive drum 82*d* to the intermediate transfer belt 87 at the primary transfer nip portion N1 of the primary transfer roller 85*d*. Magenta, cyan and black toner images are also primarily transferred to the intermediate transfer belt 87 in the same manner with a predetermined timing at the primary transfer nip portion N1.

The registration detecting sensor 71 detects the registration correcting patterns of each color formed on the intermediate transfer belt 87 and the control portion 101 detects a color shift amount with respect to yellow, i.e., a reference color, and stores it in the memory 102.

Thus, according to the present embodiment, the exposure from the exposure unit 50*d* is started after when the fogging toner arrives at all of the primary transfer nip portions N1 of the image forming portions 81Bk, 81C, 81M and 81Y. Due to that, the coefficient of friction at the primary transfer nip portion N1 becomes μ2 which is lower than that during the normal time, so a relationship of the following equation (Eq. 1) holds:

$$\mu 2 \times F2 \times 4 < \mu 1 \times F1 \quad \text{Eq. 1}$$

where, μ1 is a coefficient of friction of the driving roller 88, F1 is nip pressure between the driving roller 88 and the secondary transfer roller 90, μ2 is a coefficient of friction between the photoconductive drums 82*a* through 82*d* and the intermediate transfer belt 87 when there exists toner at the primary transfer nip portion N1, and F2 is nip pressure of the primary transfer nip portion N1.

This arrangement makes it possible to correct color shift favorably in a state in which no slip occurs between the driving roller 88 and the intermediate transfer belt 87.

As described above, the normal color shift correcting mode is adopted until when the predetermined number of sheets (80 (thousand sheets) in the present embodiment) during which the coefficient of friction μ1 of the driving roller 88 does not drop, it is possible to obtain the following effects. That is, it is possible to carry out the detection of the color shift amount and printing on the recording medium favorably while preventing a surface layer of the photosensitive body from being scraped by rubbing with the developing rollers 84*a* through 84*d* at timing other than the developing operation and a life of the photosensitive body from being shortened.

Still further, the low μ color shift correcting mode is adopted and the timing for starting the exposure is retarded when the number of sheets exceeds the predetermined number of sheets, e.g., 80 (thousand sheets), during which the coefficient of friction μ1 of the driving roller 88 drops. Then, the exposure from the exposure unit 50*d* is started after when the fogging toner arrives at all of the four primary transfer nip portions N1. Therefore, it becomes possible to correct a color shift in a state in which no slip occurs between the driving roller 88 and the intermediate transfer belt 87 and to form a good image having no color shift on a recording medium.

It is noted that the present embodiment may be arranged also as follows. That is, the number of sheets which has been the predetermined condition in switching the modes in the detection of the color shift amount may be differentiated from what described above in order to prevent a life of the developer and the photoconductive drums from dropping. In such a case, the low μ color shift correcting mode may be adopted from the beginning.

Second Embodiment

Figure 8:
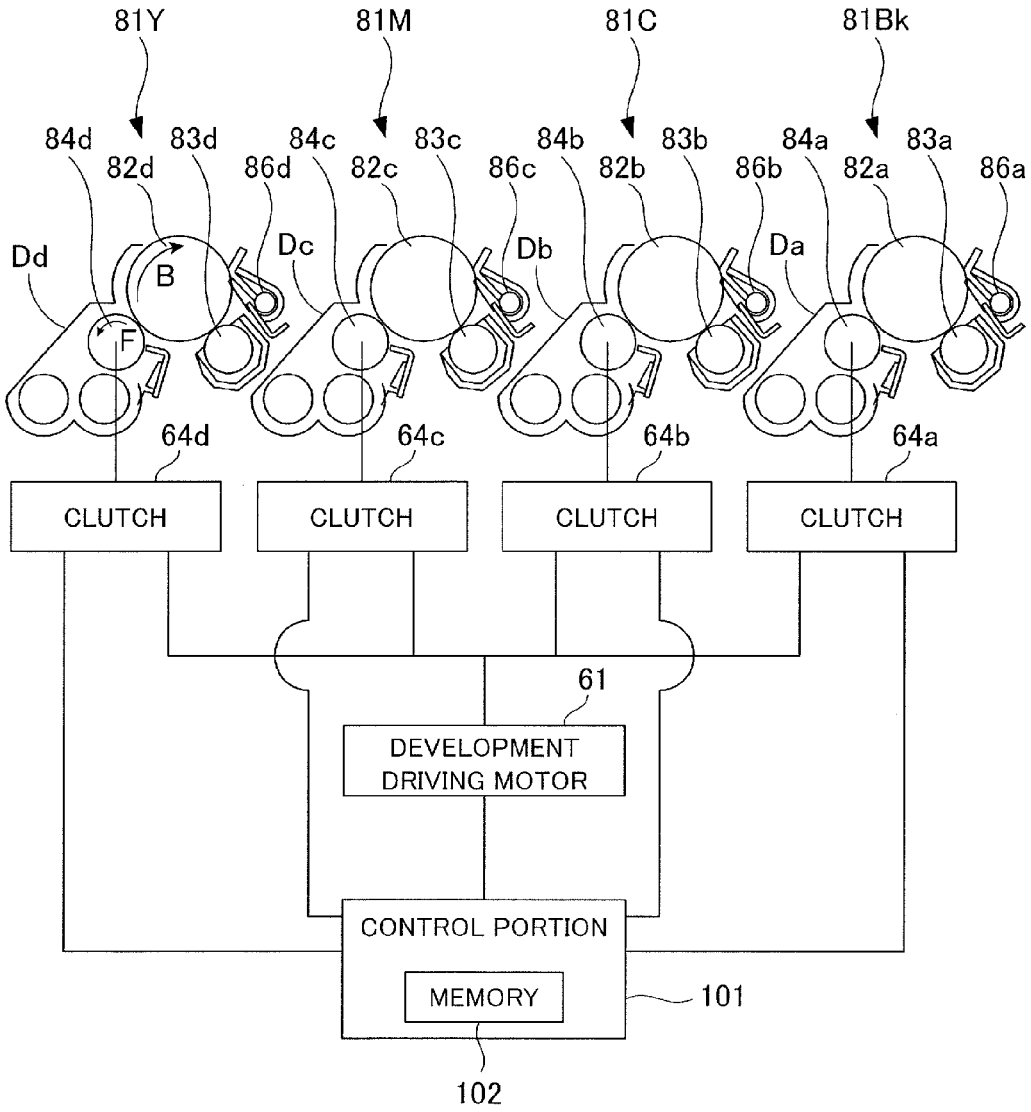
FIG. 8 is a block diagram showing a control system in driving the developing units according to a second embodiment of the present invention.
Figure 9:
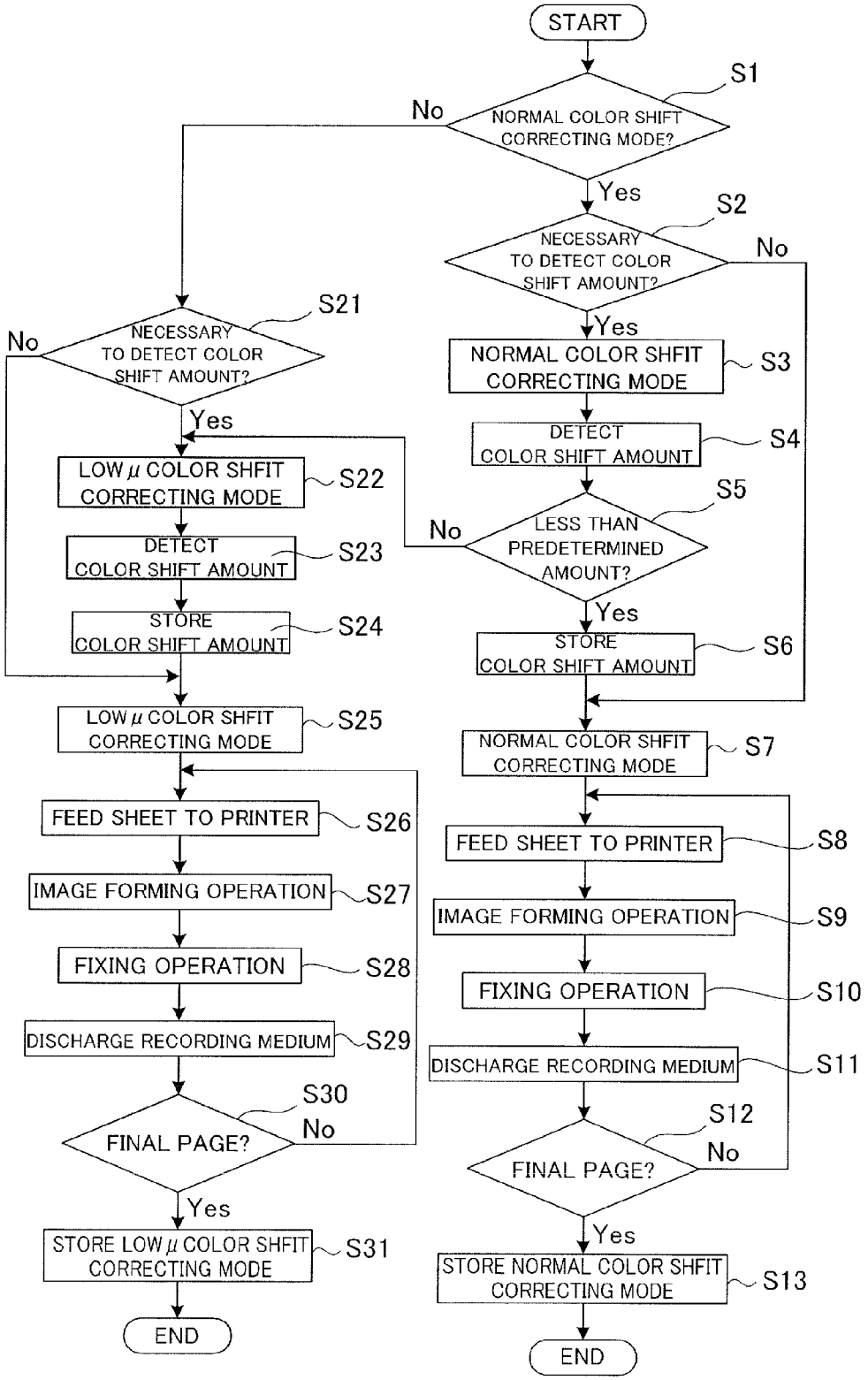
FIG. 9 is a flowchart explaining operations in selecting modes of the image forming portions of the second embodiment.
Figure 10:
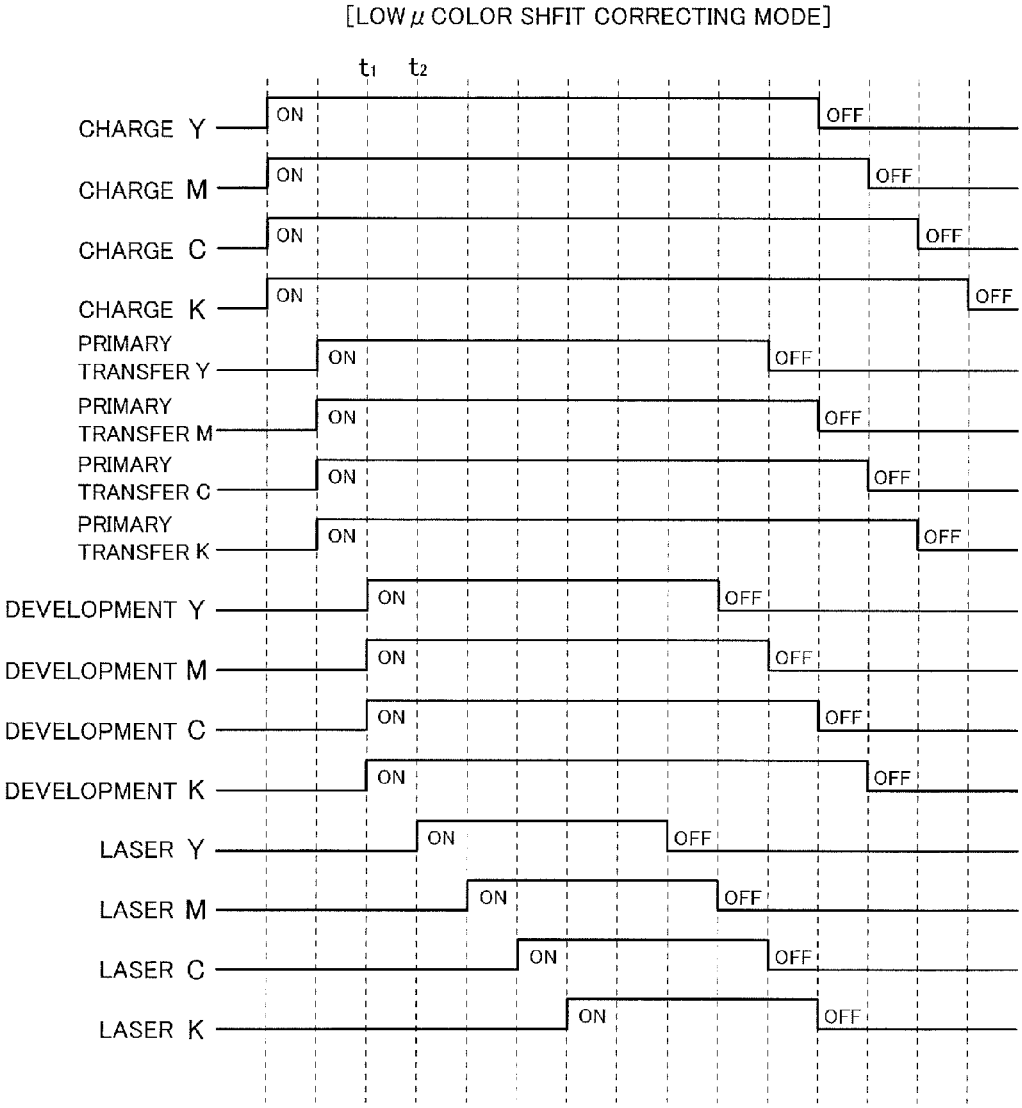
FIG. 10 is a time chart showing driving states of the image forming portion during the low μ color shift correction mode in the second embodiment.

Next, a second embodiment of the present invention will be explained with reference to FIGS. 8 and 9. It is noted that FIG. 8 is a block diagram showing a configuration for driving and controlling the developing units, FIG. 9 is a flowchart explaining an operation of a mode selecting portion of the image forming portion, FIG. 10 is a time chart showing the driving states of the image forming portions. Because the configuration of the image forming apparatus 100 of the present embodiment is the same with that of the first embodiment shown in FIGS. 1 and 2, the components of the second embodiment common with those of the first embodiment will be denoted by the same reference numerals and an explanation thereof will be omitted here.

As shown in FIG. 8, while the developing units Da through Dd are driven by the development driving motor 61 composed of a DC motor, clutches 64*a* through 64*d* each composed of an electromagnetic clutch are used as the clutch switching the drive transmission and non-transmission states in the present embodiment. These clutches (referred as 'electromagnetic clutches hereinafter) 64*a* through 64*d* are constructed to be switchable at any timing in the present embodiment. The drive of the development driving motor 61 and switching of the states of the electromagnetic clutches 64*a* through 64*d* are controlled by the control portion 101.

The timing, i.e., the normal color shift correcting mode, shown in FIG. 4 is adopted for the timing of the driving states of the image forming portions before the coefficient of friction μ1 of the driving roller 88 drops in the present embodiment. Then, the timing, i.e., the low μ color shift correcting mode, shown in FIG. 10 is adopted for the timing of the driving states of the image forming portions after when the coefficient of friction μ1 of the driving roller 88 drops and slip occurs between the driving roller 88 and the intermediate transfer belt 87.

The control portion 101 judges a switching timing of the normal color shift correcting mode and the low μ color shift correcting mode from variation (positional shift amount) of a plurality of distances between yellow and black measured in detecting the color shift amount. Then, when a fluctuation caused by a normal driving component becomes greater than a predetermined fluctuation (predetermined value: 100 μm in the present embodiment), the control portion 101 judges that the coefficient of friction μ1 of the driving roller 88 has dropped and a slip has occurred between the driving roller 88 and the intermediate transfer belt 87. Based on this judgment, the control portion 101 shifts to the low μ color shift correcting mode and stores that effect and the correcting amount obtained in the low μ color shift correcting mode in the memory 102.

In the embodiment described above, the registration detecting sensor 71 (FIG. 1) composes a detecting portion detecting the respective test toner images transferred from the photoconductive drums 82*d* and 82*a* (first and second image carriers) to the intermediate transfer belt 87. That is, the registration detecting sensor 71 detects a positional shift amount of the respective toner images (the respective test toner images) primarily transferred from the photoconductive drum 82*d* and the photoconductive drum 82*a* to the intermediate transfer belt 87 in a superimposed condition.

The control portion 101 of the present embodiment also switches the low μ color shift correcting mode (the first test mode) and the normal color shift correcting mode (the second test mode) corresponding to the positional shift amount of the respective toner images detected by the registration detecting sensor 71. That is, the control portion 101 executes the normal color shift correcting mode (the second test mode) when a change from the reference value is less than a predetermined value on a basis of a result detected by the registration detecting sensor 71. Then, the control portion 101 executes the low μ color shift correcting mode (the first test mode) in the case where the detected positional shift amount is greater than the predetermined value. It is noted that the predetermined value may be 100 μm for example.

The control portion 101 judges the positional shift amount by using the distance between yellow and black from the following reason. That is, because the exposure of yellow is started at earliest time and the exposure of black is started at latest time, the variation amount appear to be largest if a plurality of registration correcting patterns of yellow is formed during a time until when toner arrives at the primary transfer nip portion N1 of black.

The registration correcting operation in the normal color shift correcting mode of the present embodiment is the same with that of the first embodiment, so that only the registration correcting operation in the low μ color shift correcting mode will be explained here with reference to FIG. 10.

At first, the control portion 101 turns ON the charging unit 83*d* of yellow, the charging unit 83*c* of magenta, the charging unit 83*b* of cyan, and the charging unit 83*a* of black in the same time. Then, the control portion 101 applies the primary transfer bias to the primary transfer roller 85*d* of yellow, the primary transfer roller 85*c* of magenta, the primary transfer roller 85*b* of cyan, and the primary transfer roller 85*a* of black and turns them ON in the same time.

In succession, the control portion 101 puts the drive of the electromagnetic clutch 64*d* of yellow, the electromagnetic clutch 64*c* of magenta, the electromagnetic clutch 64*b* of cyan, and the electromagnetic clutch 64*a* of black into the transmission state in the same time. Thereby, the control portion 101 turns ON the developing unit Dd of yellow, the developing unit Dc of magenta, the developing unit Db of cyan, and the developing unit Da of black (time $t_1$ in FIG. 10).

Thus, after turning ON the charging units 83*a* through 83*d* in the same time, the control portion 101 turns ON the application of the primary transfer bias to the primary transfer rollers 85*a* through 85*d* and the developing units Da through Dd, respectively in the same time. This makes it possible to make the fogging toner arrive at all of the primary transfer nip portions N1 in a shortest time.

As described above, according to the present embodiment, the control portion 101 executes the application of the developing bias respectively to the first developing portion (the exposure unit 50*d*) and the second developing portion (the exposure unit 50*a*) at the same timing. This control is applicable also in the first embodiment and in a third embodiment described later.

After waiting for the fogging toner to arrive at the primary transfer nip portion N1, the control portion 101 irradiates the laser beam as the scanning beam to each of the photoconductive drums on a basis of image information to form the latent images to be formed as the registration correcting patterns of each color on the intermediate transfer belt 87. That is, the laser beam is irradiated as the scanning beam from the exposure unit 50*d* of yellow to the photoconductive drum 82*d* of yellow (time $t_2$), from the exposure unit 50*c* of magenta to the photoconductive drum 82*c* of magenta, from the exposure unit 50*b* of cyan to the photoconductive drum 82*b* of cyan, and from the exposure unit 50*a* of black to the photoconductive drum 82*a* of black. In the yellow image forming process, the electrostatic latent image is formed on the photoconductive drum 82*d* charged by the charging unit 83*d* as the photoconductive drum 82*d* is exposed.

After that, the yellow toner frictionally electrified within the developing unit Dd is applied to the electrostatic latent image on the photoconductive drum 82*d* to form a toner image. The toner image thus formed is transferred from the photoconductive drum 82*d* to the intermediate transfer belt 87 at the primary transfer nip portion N1 of the primary transfer roller 85*d*.

The magenta, cyan, and black image processes are also carried out in the same manner at predetermined timings by sequentially transferring toner images to the intermediate transfer belt 87 at the corresponding primary transfer nip portions N1. The registration detecting sensor 71 detects the toner images (registration correcting patterns) of each color thus formed on the intermediate transfer belt 87, and the control portion 101 detects a color shift amount with respect to yellow, i.e., the reference color, and stores it in the memory 102.

It is noted that although FIG. 10 describes the timing (time $t_1$) when the developing unit Da is turned ON and the timing (time $t_2$) when the exposure unit 50*d* is turned ON with the continuous same timing, the timing is not limited to that timing. That is, it is also possible to control such that the exposure unit 50*d* is turned ON slightly later than the time $t_2$ shown in FIG. 10 after when the developing unit Da is turned ON. This arrangement also enables to obtain the same effect.

Thus, the exposure from the exposure unit 50*d* is started after when the fogging toner arrives at all of the four primary transfer nip portions N1. Due to that, the coefficient of friction at the primary transfer nip portion N1 becomes μ2 which is lower than that during the normal time, so a relationship of the following equation (Eq.1) holds:

$$\mu 2 \times F2 \times 4 < \mu 1 \times F1 \qquad \text{Eq. 1}$$

This arrangement makes it possible to correct the color shift favorably in a state in which no slip occurs between the driving roller 88 and the intermediate transfer belt 87.

Here, an operation for switching the normal color shift correcting mode and the low μ color shift correcting mode in a case where printing is required in the image forming apparatus 100 will be explained with reference to FIG. 9.

In response to an input of a print start signal in the image forming apparatus 100, the control portion 101 judges whether or not the normal color shift correcting mode ins adopted by confirming the state stored in the memory 102 in Step S1. As a result, if the mode is the normal color shift correcting mode, the control portion 101 advances to Step S2 and if the mode is the low μ color shift correcting mode, the control portion 101 advances to Step S21. In Step S2, the control portion 101 judges whether it is necessary to detect a color shift amount by confirming whether or not the power source is turned ON, a predetermined number of recording media has been printed, or a predetermined time has elapsed.

If the control portion 101 judges that it is necessary to detect the color shift amount here, the control portion 101 advances to Step S3 and if the control portion 101 judges that it is not necessary to detect the color shift amount, the control portion 101 advances Step S7. In Step S3, the control portion 101 puts the timing of the driving states of the image forming portions 81Bk through 81Y into the normal color shift correcting mode, executes the registration correcting operation in the normal color shift correcting mode described above in Step S4, and detects the color shift amount with respect to yellow, i.e., the reference value.

Then, in Step S5, the control portion 101 judges whether or not variation of the distance between yellow and black is less than the predetermined amount, and if it is less than the predetermined amount, the control portion 101 advances to Step S6 and if it exceeds the predetermined amount, the control portion 101 advances to Step S22. In Step S6, the control portion 101 stores the color shift amount thus detected in the memory 102 and updates the color shift correcting amount.

Next, the control portion 101 advances to Step S7 to put the timing of the driving states of the image forming portions 81Bk through 81Y into the normal color shift correcting mode. Still further, the control portion 101 feeds the recording medium from the sheet feed cassette 92 one by one by the sheet feeding roller 93 in Step S8 and executes the image forming operation in the normal color shift correcting mode described above in Step S9.

The toner image which has been formed on the recording medium is fixed by heat by the fixing unit 95 in Step S10 and is conveyed and discharged to the sheet discharge tray 98 by the conveying roller pair 96 and the sheet discharge roller pair 97 in Step S11.

Next, in Step S12, the control portion 101 judges whether or not a recording medium is a final page, and if it is the final page, the control portion 101 advances to Step S13 and if it is not the final page, returns to Step S8 to start to feed a next recording medium. In Step S13, the control portion 101 stores that the mode is the normal color shift correcting mode in the memory 102 and ends the process.

Meanwhile in Step S21 advanced from the Step S1, the control portion 101 judges whether or not it is necessary to detect a color shift amount similarly to Step S2. If the control portion 101 judges that it is necessary to detect the color shift amount here, the control portion 101 advances to Step S22 and if the control portion 101 judges that it is not necessary to detect the color shift amount, the control portion 101 advances to Step S25.

In Step S22, the control portion 101 puts the timing of the driving states of the image forming portions 81Bk through 81Y into the low μ color shift correcting mode, executes the registration correcting operation in the low μ color shift correcting mode described above in Step S23, and detects the color shift amount with respect to the yellow, i.e., the reference value.

In succession, the control portion 101 stores the color shift amount thus detected in the memory 102 in Step S24 and updates the color shift correcting amount. Then, the control portion 101 advances to Step S25 to put the timing of the driving states of the image forming portions 81Bk through 81Y into the low μ color shift correcting mode. In Step S26, the control portion 101 feeds the recording medium one by one from the sheet feed cassette 92 by the sheet feeding roller 93. Further, the control portion 101 executes the image forming operation in the low μ color shift correcting mode described above in Step S27.

The toner image which has been formed on the recording medium is fixed by heat by the fixing unit 95 in Step S28 and is conveyed and discharged to the sheet discharge tray 98 by the conveying roller pair 96 and the sheet discharge roller pair 97 in Step S29.

Next, in Step S30, the control portion 101 judges whether or not a recording medium is a final page, and if it is the final page, the control portion 101 advances to Step S31 and if it is not the final page, returns to Step S26 to start to feed a next recording medium. In Step S31, the control portion 101 stores that the mode is the low μ color shift correcting mode in the memory 102 and ends the process.

It is noted that in the process described above, a process in a case where the intermediate transfer belt 87 is replaced with new one due to further advance of adhesion of flying toner, paper powder and the like after switching from the normal color shift correcting mode to the low μ color shift correcting mode is preferable to arrange as follows for example.

That is, before judging in Step S1 in FIG. 9, the control portion 101 judges whether or not reset process has been made in replacing the intermediate transfer belt 87. In such a case, if the control portion 101 judges that the reset has been done from the judgment of the existence of the reset, the control portion 101 starts the process from Step S2 by jumping the judgment in Step S1. Then, if it is judged that no reset has been made, the control portion 101 starts from the judgment in Step S1 and proceeds the processes as described above. Such process makes it possible to carry out the smooth switching of the modes regardless of the replacement of the intermediate transfer belt 87.

As described above, because the ON/OFF states of the developing units Da through Dd can be switched in the same time by the electromagnetic clutches 64*a* through 64*d*, ON time of the developing units Da through Dd during the low μ color shift correcting mode can be minimized. Due to that, it is possible to prevent the surface layer of the photosensitive body from being scraped by rubbing with the developing rollers 84*a* through 84*d* at timing other than the developing operation and to prevent the life thereof from dropping in the normal color shift correcting mode and to minimize them even in the low μ color shift correcting mode.

Still further, because it is detected whether or not a slip has occurred between the driving roller 88 and the intermediate transfer belt 87 in detecting the color shift amount, the shift to the low μ color shift correcting mode can be also minimized. Then, during the low μ color shift correcting mode, the exposure from the exposure unit 50*d* can be started after when the fogging toner has arrived at all of the four primary transfer nip portions N1. Therefore, it becomes possible to correct a color shift in the state in which no slip occurs between the driving roller 88 and the intermediate transfer belt 87 and to print a favorable image having no color shift on the recording medium.

Third Embodiment

Figure 11:
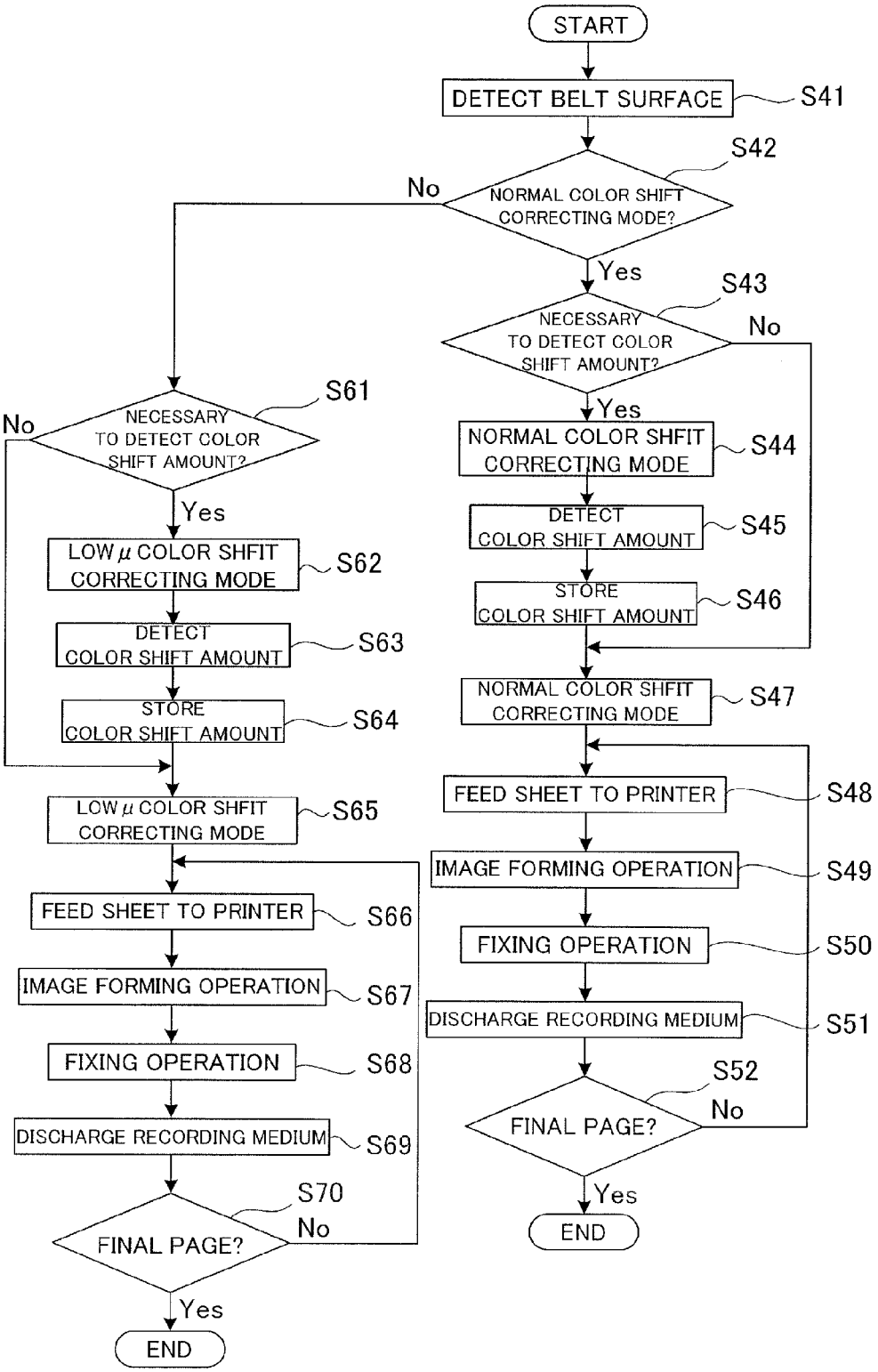
FIG. 11 is a flowchart explaining operations in selecting modes of the image forming portions according to a third embodiment of the invention.

Next, a third embodiment of the present invention will be explained with reference to FIG. 11. FIG. 11 is a flowchart explaining operations of mode selecting portions of the image forming portions 81Bk through 81Y of the present embodiment. It is noted that because the configuration of the image forming apparatus 100 of the present embodiment is the same with that of the second embodiment shown in FIGS. 1, 2 and 8, the common components will be denoted by the same reference numerals and an explanation thereof will be omitted here.

Similarly to the second embodiment, the timing in the normal color shift correcting mode shown in FIG. 4 is adopted as the timing of the driving states of the image forming portions before when the coefficient of friction μ1 of the driving roller 88 drops in the present embodiment. Then, the timing of the low μ color shift correcting mode shown in FIG. 10 is adopted as the timing of the driving states of the image forming portion after when the coefficient of friction μ1 of the driving roller 88 has dropped and when a slip has occurred between the driving roller 88 and the intermediate transfer belt 87.

Switching of the normal color shift correcting mode and the low μ color shift correcting mode is made by the control portion 101 by measuring a time during which a substrate pattern of the intermediate transfer belt 87 makes a turn (one rotation) by using the registration detecting sensor 71. Then, if the time increases to be more than a predetermined time (1 ms in the present embodiment), the control portion 101 judges that the coefficient of friction μ1 of the driving roller 88 has dropped and a slip has occurred between the driving roller 88 and the intermediate transfer belt 87, and shift the normal color shift correcting mode to the low μ color shift correcting mode. Still further, the control portion 101 stores that effect in the memory 102.

Thus, the image forming apparatus of the present embodiment includes the registration detecting sensor 71 as a rotation time detecting portion detecting a time during which the intermediate transfer belt 87 rotates. The control portion 101 executes the normal color shift correcting mode (second test mode) in the case where an accumulated rotation time of the specific intermediate transfer belt 87 detected by the registration detecting sensor 71 is less than the predetermined time. The control portion 101 also executes the low μ color shift correcting mode (first test mode) in the case where the accumulated rotation time thus detected is greater than the predetermined time.

The registration correcting operation in the normal color shift correcting mode and the low μ color shift correcting mode is the same with those in the first and second embodiments, so that an explanation thereof will be omitted here.

The operating in switching the normal color shift correcting mode and the low μ color shift correcting mode when the image forming apparatus 100 is required to print will be explained with reference to FIG. 11.

That is, in response to an input of a print start signal to the image forming apparatus 100, the control portion 101 measures a time during which the substrate pattern of the intermediate transfer belt 87 rotates one lap in Step S41. Then, the control portion 101 judges whether or not this measured time is longer than the predetermined time in Step S42, and if it is less than the predetermined time, the control portion 101 advances to Step S43 in the normal color shift correcting mode. If the measured time exceeds the predetermined time, the control portion 101 advances to Step S61 in the low μ color shift correcting mode.

In Step S43, the control portion 101 confirms that if it is the time when the power source has been turned ON, a predetermined number of recording media has been printed, or a predetermined time has elapsed, and judges whether or not it is necessary to detect a color shift amount. If the control portion 101 judges that it is necessary to detect the color shift amount here, the control portion 101 advances to Step S44 and if the control portion 101 judges that it is not necessary to detect the color shift amount, the control portion 101 advances to Step S47.

In Step S44, the control portion 101 puts the timing of the driving states of the image forming portions 81Bk through 81Y into the normal color shift correcting mode, executes the registration correcting operation in the normal color shift correcting mode described above and detects the color shift amount with respect to yellow, i.e., the reference value in Step S45. In Step S46, the control portion 101 stores the color shift amount thus detected in the memory 102 and updates the color shift correcting amount.

Next, the control portion 101 advances to Step S47 to put the timing of the driving states of the image forming portions 81Bk through 81Y into the normal color shift correcting mode. Still further, the control portion 101 feeds the recording medium from the sheet feed cassette 92 one by one by the sheet feeding roller 93 in Step S48 and executes the image forming operation in the normal color shift correcting mode described above in Step S49. The toner image which has been formed on the recording medium is fixed by heat by the fixing unit 95 in Step S50 and is conveyed and discharged to the sheet discharge tray 98 by the conveying roller pair 96 and the sheet discharge roller pair 97 in Step S51.

Next, in Step S52, the control portion 101 judges whether or not a recording medium is a final page, and if it is the final page, the control portion 101 ends the process. If it is not the final page, the control portion 101 returns to Step S48 to start to feed a next recording medium.

Meanwhile in Step S61 advanced from the Step S42, the control portion 101 judges whether or not it is necessary to detect a color shift amount similarly to Step S43. If the control portion 101 judges that it is necessary to detect the color shift amount, the control portion 101 advances to Step S62 and if the control portion 101 judges that it is not necessary to detect the color shift amount, the control portion 101 advances to Step S65.

In Step S62, the control portion 101 puts the timing of the driving states of the image forming portions 81Bk through 81Y into the low μ color shift correcting mode, executes the registration correcting operation in the low μ color shift correcting mode described above, and detects the color shift amount with respect to yellow, i.e., the reference value in Step S63. In Step S64, the control portion 101 stores the color shift correcting amount thus detected in the memory 102 and updates the color shift amount.

Next, the control portion 101 advances to Step S65 to put the timing of the driving states of the image forming portions 81Bk through 81Y into the low μ color shift correcting mode. Still further, the control portion 101 feeds the recording medium from the sheet feed cassette 92 one by one by the sheet feeding roller 93 in Step S66 and executes the image forming operation in the low μ color shift correcting mode described above in Step S67.

The toner image which has been formed on the recording medium is fixed by heat by the fixing unit 95 in Step S68 and is conveyed and discharged to the sheet discharge tray 98 by the conveying roller pair 96 and the sheet discharge roller pair 97 in Step S69. Next, in Step S70, the control portion 101 judges whether a recording medium is a final page or not, and if it is the final page, the control portion 101 ends the process and if it is not the final page, the control portion 101 returns to Step S66 to start to feed a next recording medium.

According to the present embodiment described above, the control portion 101 measures the time during which the substrate pattern of the intermediate transfer belt 87 rotates one lap by using the registration detecting sensor 71. Then, if the time increases more than the predetermined time, e.g., 1 ms, the control portion 101 detects whether or not the coefficient of friction μ1 of the driving roller 88 has dropped and a slip has occurred between the driving roller 88 and the intermediate transfer belt 87. Therefore, it is possible to minimize a shift time to the low μ color shift correcting mode.

During the low μ color shift correcting mode, the exposure from the exposure unit 50*d* can be started after when the fogging toner has arrived at all of the four primary transfer nip portions N1. Therefore, it becomes possible to carryout the color shift correction in the state in which no slip occurs between the driving roller 88 and the intermediate transfer belt 87 and to print a favorable image having no color shift to the recording medium.

While the first and third embodiments described above have been explained by setting the photoconductive drum 82*d* as the first image carrier, the photoconductive drum 82*a* as the second image carrier, the developing unit Dd as the first developing portion, and the developing unit Da as the second developing portion, the relationship between the first and second components is not limited to that. That is, when the photoconductive drum 82*d* is set as the first image carrier, it is possible to assume the photoconductive drum 82*c* or the photoconductive drum 82*b* as the second image carrier.

In such a case, at a point of time when the exposure to the photoconductive drum 82*d*, i.e., the first image carrier, is started, the fogging toner has arrived at the primary transfer nip portion N1 of the photoconductive drum 82*c* or the primary transfer nip portion N1 of the photoconductive drum 82*b*. Accordingly, as compared to the case where the fogging toner has arrived at all of the primary transfer nip portion N1 of the photoconductive drums 82*c* through 82*a* at the point of time when the exposure to the photoconductive drum 82*d* is started, the coefficient of friction μ3 when there exists no toner mixedly exists. However, as compared to the prior art in which all of the photoconductive drums 82*c*, 82*b* and 82*a*, other than the photoconductive drum 82*d* as the first image carrier, have the coefficient of frictionμ3, the slip otherwise occurring between the intermediate transfer belt 87 and the driving roller 88 is lessened.

In such a case, in addition to the exposure unit 50*a*, the exposure unit 50*c* or the exposure unit 50*c* and the exposure unit 50*b* may be considered as the second exposure portion. From the same reason, not only the primary transfer roller 85*a* and the primary transfer roller 85*d*, but also the primary transfer roller 85*b* and the primary transfer roller 85*c* may be also considered as the transfer portion. It is possible to obtain substantially the same effects with those of the first through third embodiments also in this case.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-129411, filed Jun. 20, 2013, which is hereby incorporated by reference herein in its entirety.

What is claimed is:

1. An image forming apparatus comprising:

an endless belt rotatingly conveying toner images transferred thereon;

a first image carrier rotatably supported in a state in contact with the endless belt;

a second image carrier rotatably supported in a state in contact with the endless belt, in parallel with the first image carrier and downstream of the first image carrier in a rotational direction of the endless belt;

a first exposure portion exposing the charged first image carrier and forming a latent image thereon;

a second exposure portion exposing the charged second image carrier and forming a latent image thereon;

a first developing portion developing the latent image formed on the first image carrier as one of the toner images at a first developing position by applying a developing bias;

a second developing portion developing the latent image formed on the second image carrier as one of toner images at a second developing position by applying a developing bias;

a transfer portion transferring the toner image transferred from the first image carrier to the endless belt at a first transfer position and the toner image transferred from the second image carrier to the endless belt at a second transfer position collectively to a recording medium conveyed thereto; and a control portion selectively executing, corresponding to a predetermined condition, a first or second test mode correcting at least one of exposure timings of the first exposure portion and the second exposure portion after transferring test toner images respectively from the first and second image carriers to the endless belt, the control portion starting the exposure of the first exposure portion after a position of the second image carrier, having been located at a second developing position when the developing bias is started to be applied to the second developing portion, arrives at the second transfer position in forming the test toner images in the first test mode, and the control portion starting the exposure of the first exposure portion before the position of the second image carrier, having been located at the second developing position when the developing bias is started to be applied to the second developing portion, arrives at the second transfer position in forming the test toner image in the second test mode.

2. The image forming apparatus according to claim 1, wherein the control portion executes the second test mode until an accumulated number of times of transfer from the endless belt to the recording media carried out by the transfer portion exceeds a predetermined number of times, and executes the first test mode after the accumulated number of times of transfer exceeds the predetermined number.

3. The image forming apparatus according to claim 1, further comprising a detecting portion detecting the respective test toner images transferred from the first and second image carriers to the endless belt, wherein the control portion executes the second test mode in a case where a detected color shift amount from a reference value on a basis of a result detected by the detecting portion is less than a predetermined value and executes the first test mode in a case where the detected color shift amount is greater than the predetermined value.

4. The image forming apparatus according to claim 1, further comprising a rotation time detecting portion detecting a rotation time of the endless belt, wherein the control portion executes the second test mode in a case where an accumulated rotation time of the specific endless belt detected by the rotation time detecting portion is less than a predetermined time and executes the first test mode in a case where the detected accumulated rotation time is greater than the predetermined time.

5. An image forming apparatus comprising:

an endless belt rotatingly conveying toner images transferred thereon;

a first image carrier rotatably supported in a state in contact with the endless belt;

a second image carrier rotatably supported in a state in contact with the endless belt, in parallel with the first image carrier, and downstream of the first image carrier in a rotational direction of the endless belt;

a first exposure portion exposing the charged first image carrier and forming a latent image thereon;

a second exposure portion exposing the charged second image carrier and forming a latent image thereon;

a first developing portion developing the latent image formed on the first image carrier as a toner image at a first developing position by applying a developing bias;

a second developing portion developing the latent image formed on the second image carrier as a toner image at a second developing position by applying a developing bias;

a transfer portion transferring the toner image transferred from the first image carrier to the endless belt at a first transfer position and the toner image transferred from the second image carrier to the endless belt at a second transfer position collectively to a recording medium conveyed thereto; and a control portion starting the exposure of the first exposure portion after a position of the second image carrier, having been located at the second developing position when a developing bias is started to be applied to the second developing portion, arrives at the second transfer position in test modes correcting at least one of the exposure timings of the first exposure portion and of the second exposure portion after transferring test toner images respectively from the first and second image carriers to the endless belt.

6. The image forming apparatus according to claim 1, wherein the control portion executes the application of the developing bias to each of the first and second developing portions at the same timing.

7. The image forming apparatus according to claim 5, wherein the control portion executes the application of the developing bias to each of the first and second developing portions at the same timing.

* * * * *